United States Patent [19]

Owenby

[11] Patent Number: 5,007,125

[45] Date of Patent: Apr. 16, 1991

[54] BLANKET HAVING IMPROVED THERMAL CHARACTERISTICS IN THE PORTION COVERING THE FEET

[75] Inventor: Daniel B. Owenby, Swannanoa, N.C.

[73] Assignee: Beacon Manufacturing Company, Swannanoa, N.C.

[21] Appl. No.: 457,307

[22] Filed: Dec. 26, 1989

[51] Int. Cl.[5] ..... A47G 9/02

[52] U.S. Cl. ..... 5/486; 5/482

[58] Field of Search ..... 5/486, 482

[56] References Cited

U.S. PATENT DOCUMENTS

| | | | |
|---|---|---|---|
| 2,012,184 | 8/1935 | Cobb | 5/482 |
| 2,186,965 | 1/1940 | Fridolph | 5/482 |
| 3,072,776 | 1/1963 | Quennelville | 5/486 |
| 3,331,088 | 7/1967 | Marquette | 5/486 |
| 3,508,284 | 4/1970 | Marquette | 5/486 |
| 3,508,285 | 4/1970 | Marquette | 5/486 |

FOREIGN PATENT DOCUMENTS

| | | | |
|---|---|---|---|
| 437279 | 4/1925 | Fed. Rep. of Germany | 5/486 |
| 436853 | 11/1926 | Fed. Rep. of Germany | 5/486 |
| 226958 | 1/1925 | United Kingdom | 5/486 |
| 522216 | 6/1940 | United Kingdom | 5/482 |

*Primary Examiner*—Eric K. Nicholson

*Attorney, Agent, or Firm*—David M. Carter

[57] ABSTRACT

There is provided a blanket constructed of a woven rectangular panel with an upper portion for covering the user's torso and with a lower portion for covering the user's feet. The filler yarn is thicker in the lower portion than in the upper portion and the weave is also more dense in the lower portion. Thus the feet of the user will be better insulated than the user's torso.

6 Claims, 2 Drawing Sheets

BLANKET HAVING IMPROVED THERMAL CHARACTERISTICS IN THE PORTION COVERING THE FEET

This invention relates to blankets. More particularly it relates to woven blankets having thermal characteristics directed to specific portions of the user.

Both woven and nonwoven blankets are utilized to cover the human body to provide thermal insulation for the user when the ambient temperature is below the comfort level. A blanket is normally an elongated rectangular panel having top, bottom and side edges and is spread across the user normally covering the user from the neck down past the feet. Often the lower edge and a portion thereabove is tucked between the mattress and boxspring of the bed.

Most blankets have a uniform thermal characteristic, that is, the heat transfer through the blanket does not vary significantly from one portion of the blanket to another. It has been found that often in using a blanket of uniform thermal characteristics the lower extremities or feet of the user will become colder than the torso. This is believed to be due primarily because the temperature of the human body is higher in the core or torso than it is in the feet. Sometimes a person who has a problem with cold feet will use an extra blanket for the feet or will wear socks while sleeping. However, often the extra blanket for the feet will move out of place during the night, and it has been found that when a person wears socks the feet sometimes become too hot.

OBJECTS OF THE INVENTION

It is therefore one object of this invention to provide a blanket having improved thermal characteristics to fit the needs of the user.

It is another object to provide a blanket which overcomes the problems associated with the user having cold feet.

SUMMARY OF THE INVENTION

In the broadest form of this invention a woven or nonwoven blanket is provided which has greater thermal insulation characteristics in the region used for covering the feet than in other regions of the blanket.

In accordance with another form of this invention there is provided a blanket in the form of a rectangular panel constructed of woven yarn. The panel has top, bottom and side edges. The panel has an upper portion which is adapted to cover the torso of the user and a lower portion adapted to cover the feet of the user. The weave of the yarn in at least a part of the lower portion is more dense than the weave of the yarn in the upper portion. Thus the feet of the user will be better insulated than the torso. Preferably the filler yarn in the lower portion is also thicker than the filler yarn in the upper portion and is also raised thereby enhancing the thermal characteristics.

In the preferred form the warp yarn is uniform throughout the blanket and the filler yarn is adjusted in the lower portion. In one embodiment three closely spaced larger diameter filler yarns in the lower portion replace a single smaller diameter filler yarn in the upper portion for each movement of the loom.

BRIEF DESCRIPTION OF THE DRAWINGS

The subject matter which is regarded as the invention is set forth in the appended claims. The invention itself, however, together with further objects and advantages thereof, may be better understood by reference to the following description taken in conjunction with the accompanying drawings in which:

DESCRIPTION OF THE PREFERRED EMBODIMENTS

Figure 1:
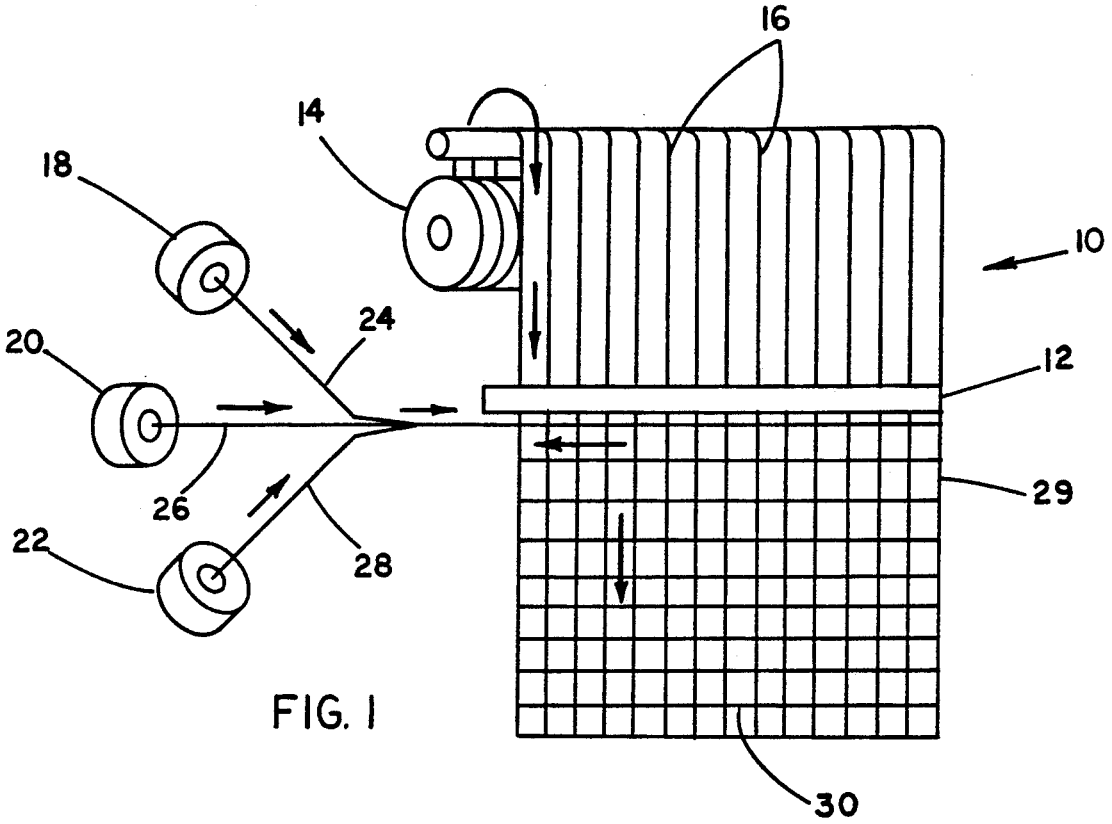
FIG. 1 is a generalized diagram of an apparatus which may be used to manufacture the blanket of the subject invention.

Referring now more particularly to FIG. 1, there is provided weaving apparatus 10 including loom 12 and warp beam 14. Warp beam 14 contains a plurality of vertical or warp yarns 16 which are fed off of warp beam 14 and move through loom 12. A plurality of cones 18, 20 and 22 feed horizontal yarns or fill yarns 24, 26, and 28 to loom 12 and are woven into warp yarns 16 as indicated, for example, by fill yarn 30. Preferably the fill yarns are two yarns plied together. The yarns may be made of natural or synthetic materials or combinations thereof. Preferably the yarns are cotton.

The operator of the weaving apparatus may readily change the fill yarns so as to change the characteristics of the blanket. For example, a single cone may be used resulting in only one fill yarn per weave or, as shown in FIG. 1, a plurality of cones may be used resulting in a plurality of fill yarns per weave. The woven combination of the warp yarn and the fill yarn forms cloth 29.

Figure 2:
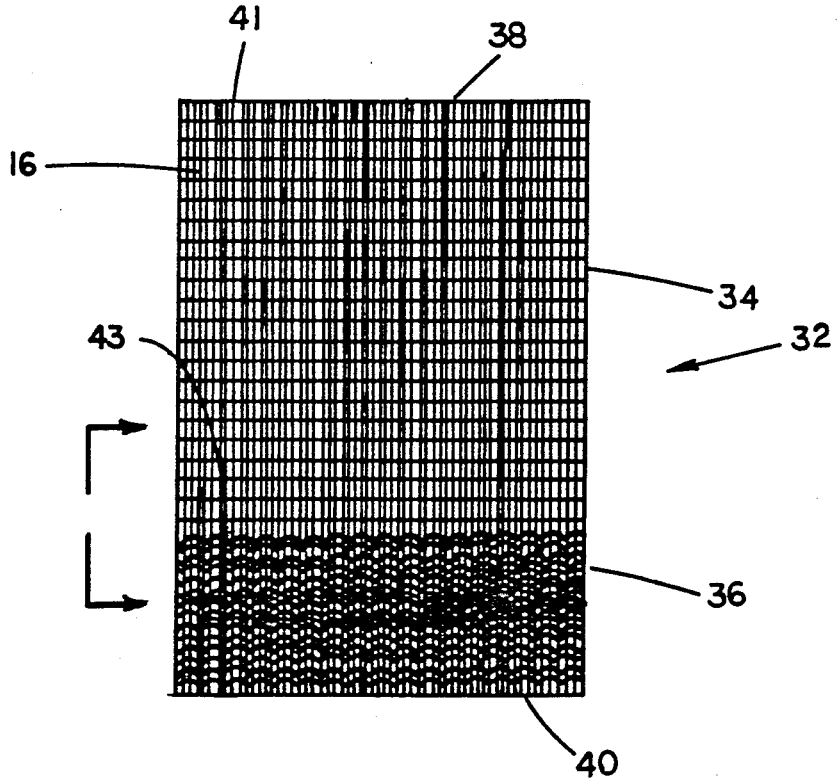
FIG. 2 is a plan view of a blanket of the subject invention.
Figure 3:
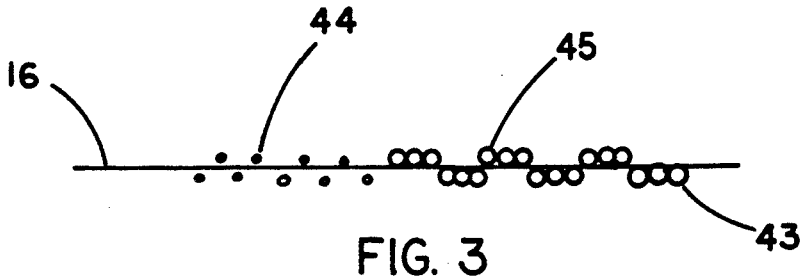
FIG. 3 is a partial sectional side view of a portion of the blanket of FIG. 2.
Figure 5:
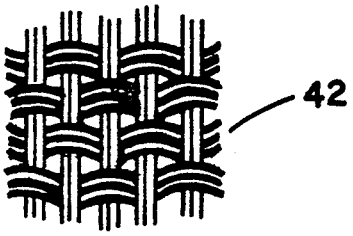
FIG. 5 is a pictorial view showing a portion of the weave pattern of the lower portion of the blanket of FIG. 2.
Figure 6:
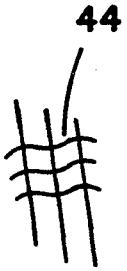
FIG. 6 is a pictorial view showing a portion of the weave pattern of the upper portion of the blanket of FIG. 2.

Referring now to FIG. 2, there is provided blanket 32 which has been woven by apparatus 10. Blanket 32 has an upper portion 34 and a lower portion 36. Blanket 32 is made using the same density and thickness of warp yarn 16 from the top edge 38 to the bottom edge 40. The upper portion 34, however, is made with a single and relatively thin filler yarn 41. In the preferred embodiment groups of three filler yarns 43 for the lower portion 36 are used. Preferably each filler yarn 45 in each group of three in the lower portion 36 is at least twice the diameter of the single filler yarn 41 in the upper portion 34. This may be better seen in reference to FIG. 3 which shows a cross section of a portion of blanket 32. As can be seen, yarns 42 which are located in lower area 36 are larger in diameter than yarns 44 which occur in upper portion 34. Yarns 42 are also closer together than yarns 44 resulting in a tighter weave. Furthermore, larger diameter yarns 42 occur in triplicates 43 and form a raised or popcorn weave as shown in FIG. 5. FIG. 6, on the other hand, shows a single filler yarn for each weave for the upper portion 34 of the blanket 32. The weave of yarns 44 is also more flat than yarns 42.

It has been found that the use of this raised weave, together with multiple yarns in each weave, traps more air thus providing improved thermal insulation in lower portion 36 of the blanket. This three filler yarn weave, combined with the increased density and the additional thickness of the yarns, further results in enhanced thermal characteristics and increased warmth in the lower section 36 which normally covers the foot of the user. The increased density of the filler yarns in lower portion 36 is achieved by slowing down the movement of the warp yarns through the loom 12 by approximately 50%.

Figure 4:
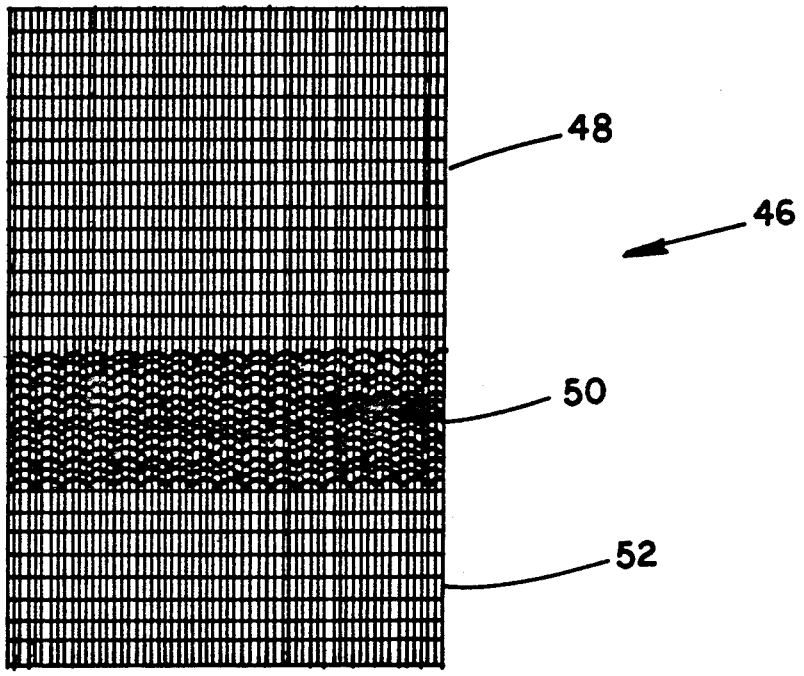
FIG. 4 shows an alternative embodiment of the blanket of FIG. 2.

Referring now more particularly to FIG. 4, which is an alternative embodiment of the blanket shown in FIG. 2, blanket 46 has an upper portion 48, middle portion 50, and lower portion 52. The middle portion 52 is of the same construction as lower portion 36 of the blanket 32 shown in FIG. 2. Upper portion 48 and lower portion 52 are of the same construction as portion 34 shown in FIG. 2. Portion 52 is left thin because it may be tucked between the mattress and boxspring so as not to waste material.

The blankets described herein provide improved thermal characteristics in the portion which normally covers the feet of the user without overly increasing the cost of the blanket. The blanket may be readily manufactured using existing weaving looms by changing filler yarns during the process and by adjusting the speed of the warp yarns.

From the foregoing description of the embodiments of the invention it will be apparent that many modifications may be made therein without departing from the true spirit and scope of the invention.

I claim:

1. A blanket comprising:

a rectangular panel constructed of woven yarn; said panel having an upper portion and a lower portion; said upper portion and said lower portion being woven together; said panel including a plurality of warp yarns and a plurality of filler yarns; said warp yarns running continuously through said upper portion and said lower portion; at least a part of said lower portion having more filler yarns per linear unit than said upper portion such that the thermal insulation characteristics of said part of said lower portion is substantially greater than the thermal insulation characteristics of said upper portion whereby the lower extremities of the user are enabled to be better insulated than other parts of the user's body; the parts of said filler yarns which pass over said warp yarns in said part of said lower portion form a weave which is more raised than the weave of said filler yarns which pass over said warp yarns in said upper portion.

2. A blanket as set forth in claim 1 wherein the density of said filler yarns are greater in said part of said lower portion than in said upper portion.

3. A blanket as set forth in claim 2 wherein said filler yarns in said part of said lower portion has a larger diameter than said filler yarns in said upper portion.

4. A blanket as set forth in claim 3 wherein said filler yarns in said part of said lower portion includes three yarns per weave and the filler yarns in said upper portion includes one yarn per weave.

5. A blanket as set forth in claim 1 wherein said lower portion includes a third portion; said third portion having substantially the same thermal insulation characteristics as said upper portion.

6. A blanket comprising:

a rectangular panel constructed of woven yarn having a lower and an upper portion; said panel including a plurality of warp yarns and a plurality of filler yarns; said warp yarns running continuously through said upper and lower portions; said upper portion and said lower portion being woven together; at least a part of said lower portion having at least two times as many filler yarns per linear unit than said upper portion wherein the density of said filler yarns is greater in said part of said lower portion than in said upper portion; said filler yarns in said part of said lower portion having a larger diameter than said filler yarns in said upper portion, wherein the thermal insulation characteristics of said part of said lower portion is substantially greater than the thermal insulation characteristics of the upper portion, whereby the lower extremities of the user are enabled to be better insulated than other parts of the user's body; the parts of said filler yarns which pass over said warp yarns in said part of said lower portion form a weave which is more raised than the weave of said filler yarns which pass over said warp yarns in said upper portion.

* * * * *